United States Patent [19]

Turley et al.

[11] Patent Number: 4,531,394

[45] **Date of Patent: * Jul. 30, 1985**

[54] SIX-HIGH ROLLING MILLS

[75] Inventors: John W. Turley, Oxford; Michael G. Sendzimir, Woodbury, both of Conn.

[73] Assignee: T. Sendzimir, Inc., Waterbury, Conn.

[ * ] Notice: The portion of the term of this patent subsequent to Jul. 31, 2001 has been disclaimed.

[21] Appl. No.: 474,009

[22] Filed: Mar. 10, 1983

Related U.S. Application Data

[63] Continuation-in-part of Ser. No. 362,460, Mar. 26, 1982, abandoned.

[51] Int. Cl.[3] ..... B21B 31/10; B21B 29/00

[52] U.S. Cl. ..... 72/238; 72/242; 72/243

[58] Field of Search ..... 72/242, 241, 243, 245, 72/238, 239

[56] References Cited

U.S. PATENT DOCUMENTS

| | | | |
|---|---|---|---|
| 3,429,166 | 2/1969 | Baker et al. | 72/242 |
| 4,270,377 | 6/1981 | Verbickas et al. | 72/242 |
| 4,462,236 | 7/1984 | Turley et al. | 72/242 |

FOREIGN PATENT DOCUMENTS

| | | | |
|---|---|---|---|
| 0130310 | 10/1980 | Japan | 72/242 |

*Primary Examiner*—Francis S. Husar
*Assistant Examiner*—Steven B. Katz
*Attorney, Agent, or Firm*—Frost & Jacobs

[57] ABSTRACT

Improved support means for the lateral support roll assemblies of a six-high rolling mill of the type having a pair of housings, a pair of vertically in-line work rolls, vertically in-line back-up rolls, intermediate in-line rolls located between the work and back-up rolls, a lateral support roll on each side of each work roll and a support roller assembly for each of the lateral support rolls. Each support roller assembly for each lateral support roll comprises a support arm providing horizontally adjustable mounting for its respective support roller assembly. The support arm is pivotally mounted to the chocks of the adjacent intermediate roll. A spacer is provided in association with the support arm to adjust the horizontal position thereof. A stationary side support beam assembly is provided to give rigid support to the spacer and the support arm.

13 Claims, 13 Drawing Figures

FIG. 1 - PRIOR ART

SIX-HIGH ROLLING MILLS

CROSS REFERENCE TO RELATED PATENTS

This application is related to the teachings of U.S. Pat. No. 4,270,377 of June 2, 1981 and U.S. Pat. No. 4,197,731 of Apr. 15, 1980, and is a continuation-in-part of application Ser. No. 06/362,460, filed Mar. 26, 1982, abandoned, in the name of the same inventors and entitled Improvements-To-Six-High-Rolling-Mills.

BACKGROUND OF THE INVENTION

The object of this invention is to provide improvements in the construction of six-high cold metal rolling mills, particularly those having lateral supports for the work rolls with the purposes of improving their torque capacity, their reliability, the quality of the rolled product and their flexibility.

BRIEF SUMMARY OF THE INVENTION

The roll arrangement of U.S. Pat. No. 4,270,377 is described as an improved six-high (1-1-1) mill arrangement, the improvement being the provision of two lateral support roll cluster assemblies for each work roll. Each of the roll cluster assemblies consists of an intermediate roll and two backing roller assemblies. This construction enables much smaller diameter work rolls to be used than in conventional prior art four-high and six-high rolling mills, and further enables work roll chocks to be eliminated.

In one embodiment of the present invention, the bearings in the backing roll assemblies are staggered in order to provide more uniform wear on the side intermediate roll, and the side intermediate roll is made from a relatively soft material to minimize the tendency of this roll to transfer wear marks from the backing rollers to the work roll (and hence to the rolled product). This embodiment also incorporates an improved mounting arrangement for the support arms upon which the backing roller assemblies are supported. This mounting arrangement makes for quick and easy removal of the intermediate rolls and side support assemblies from the mill, reducing down-time and also enabling the mill to be quickly converted to four-high operation and vice versa. It also enables existing four-high mills to be easily converted to six-high operation. Also incorporated are overload protection devices to prevent damage to the backing roller assemblies in the event that a torque overload or a mill wreck occurs.

In another embodiment of the present invention the support arms are configured to mount a single roller or set of rollers. In fact, the support arms can be configured to mount any appropriate lateral support roll assembly.

In another embodiment of the present invention, a mill is provided which is readily convertible between a conventional six-high mill and a side-supported six-high mill.

DETAILED DESCRIPTION

In U.S. Pat. No. 4,270,377, a six-high rolling mill of the 1-1-1configuration with side supported work rolls is taught, having considerably greater material reducing capacity than prior art rolling mills of the four-high variety.

Figure 1:
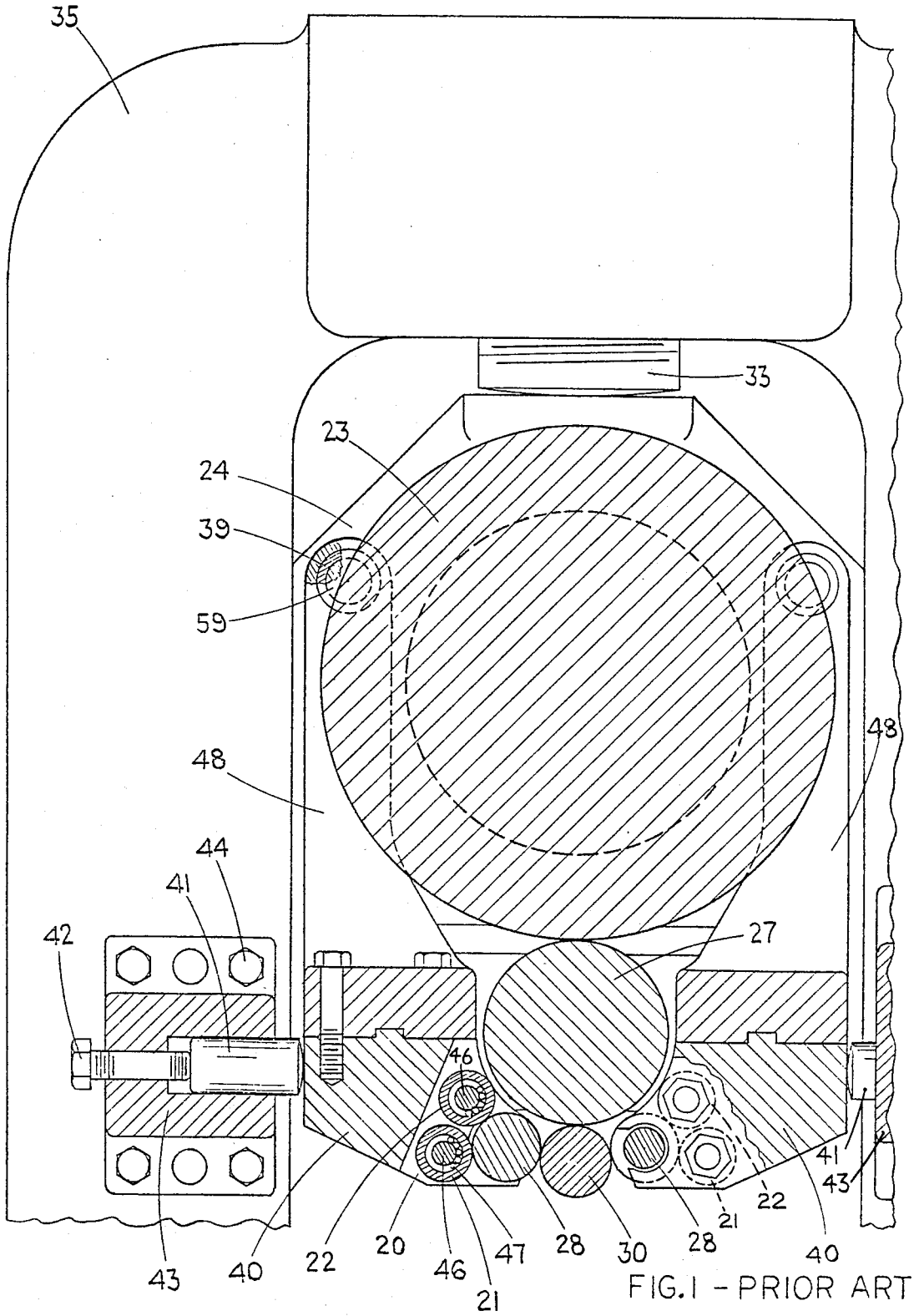
FIG. 1 is a fragmentary cross-sectional elevation of the upper half of a six-high mill with side supported work rolls according to the prior art.

The upper half of a side supported six-high rolling mill according to said U.S. Pat. No. 4,270,377 is shown in FIG. 1 and will now be described in order to aid in understanding the present invention. It will be understood that the lower half (not shown) is essentially a mirror image of the upper half.

The mill is provided with small work rolls 30 and back-up rolls 23, with intermediate rolls 27 mounted therebetween, the upper set being shown in FIG. 1. The back-up rolls and intermediate rolls are chock mounted according to the prior art and the work rolls are free-floating. Back-up roll chocks 24 are slideably mounted in mill housings 35. Rolling forces in the vertical direction are transmitted via the work rolls, intermediate rolls, back-up rolls and back-up roll chocks to screws 33 which transfer the forces to the housings. Either the back-up rolls or intermediate rolls may be driven, and rolling torque is delivered to the work rolls by frictional drive from the intermediate rolls. The torque force which arises acts in a horizontal direction on the work rolls in the opposite direction to the direction of strip travel.

Figure 2:
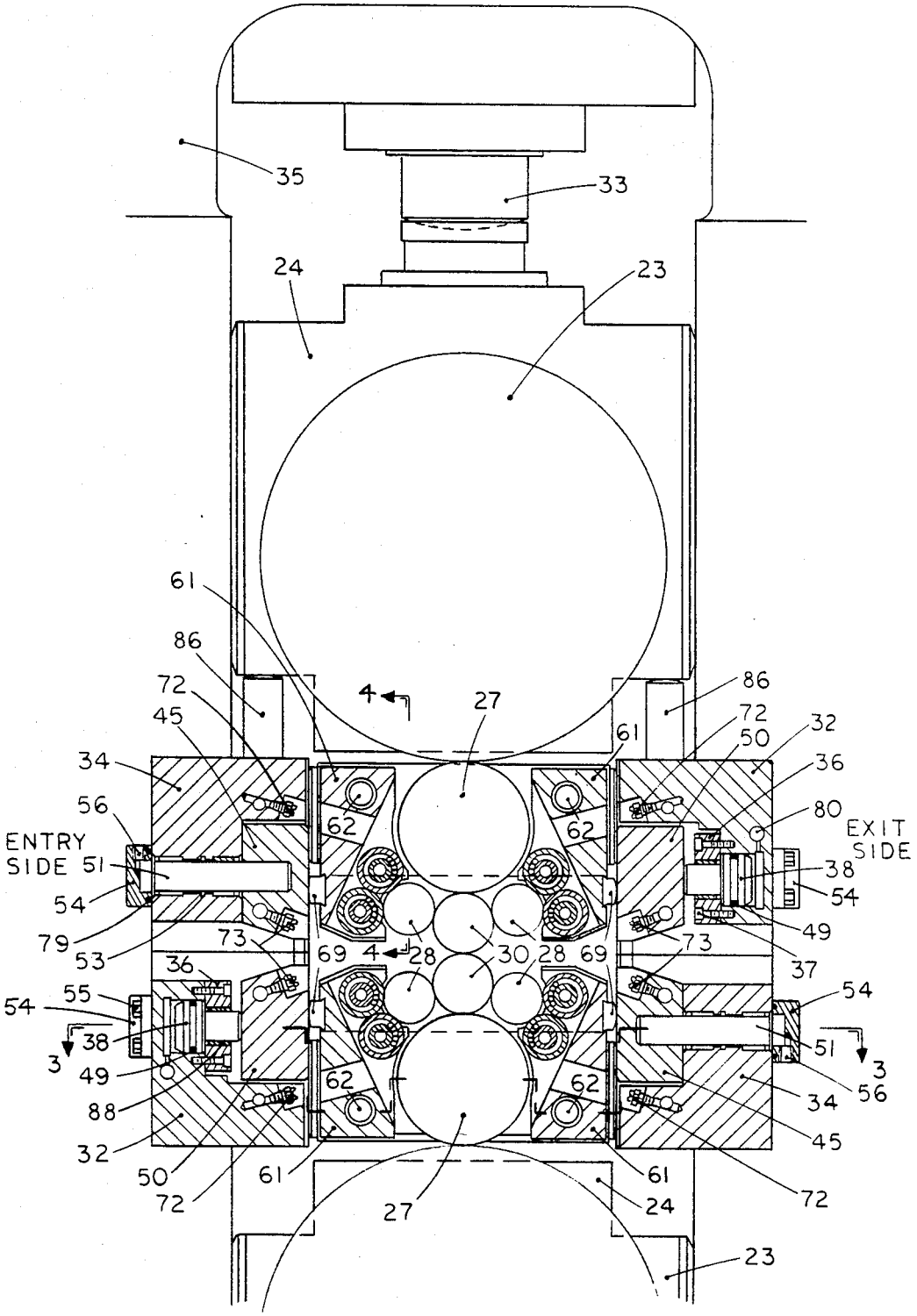
FIG. 2 is a fragmentary cross-sectional elevation of a mill according to one embodiment of the present invention.

Each work roll is supported by two roll cluster assemblies, also known as the lateral or side support roll assemblies, which provide the necessary horizontal reaction force to support the work roll in position. The left side roll cluster assembly supports the work roll when rolling in a left-to-right direction, and the right side cluster assembly supports the work roll when rolling in a right-to-left direction. Each roll cluster assembly consists of a side support roll 28 and two sets of rollers 21 and 22. Each roller set is mounted on roller bearing sets 47 and a stationary shaft 46. Each shaft 46 is supported at several points along its length by ribs 20 in side support beam 40, each side support beam 40 being suspended by pivot arms 48, pivot bushings 39 and pins 50 from back-up roll chocks 24. Each side support beam 40 is adjustably supported by pins 41 and screws 42, the pins being guidably mounted in a spacer beam 43 which spans between mill housings 35 and is attached thereto by screws 44. Screws 42 are used to adjust the position of the work roll to ensure that it is vertically in line with its respective intermediate and back-up rolls, and to take out excessive horizontal clearance between the work roll 30 and side support rolls 28 which would otherwise arise as these rolls are reground during their life. (Only a small working clearance should remain after adjustment.) A rolling mill incorporating improvements according to the present invention is shown in FIG. 2. It can be seen that this mill has the same roll configuration as the rolling mill of FIG. 1 (like parts having been given like index numerals), but differs in respect of the adjustable side support beams, each of which is now split into several parts.

In the following description of one embodiment of the present invention, reference should also be made to FIGS. 3–7. With the prior art construction of FIG. 1, it is necessary to change back-up rolls 23 whenever it is desired to remove intermediate roll 27 and side support roll assemblies from the mill (for example, for maintenance purposes or to replace worn rolls). Changing of back-up rolls is a time-consuming operation and would normally take up to eight hours on a four-high or six-high rolling mill. This represents a considerable amount of lost production. To enable the intermediate rolls and side support roll assemblies to be removed much more rapidly, an improved side support beam construction is adopted. As is most clearly shown in FIG. 3, pivot shafts 62 are mounted in and span between drive side intermediate roll chock 60 and operator side intermediate roll chock 66. Lugs 65 are provided on chocks 60 and 66, and these are provided with holes which engage with the ends of the pivot shafts 62. Spring dowels 64 are used to retain shafts 62 in lugs 65. Operator side chock 66, which may be of two-piece construction (as shown) or of one-piece construction, is provided with slots into which keeper plates 67, locked by screws 68, slide in order to locate the whole assembly of intermediate roll, chocks, pivot shafts and side support roll assemblies within the mill housing.

Support arms 61 are provided in order to mount the side support roll assemblies, the support arms having holes drilled full length within which pivot shafts 62 are mounted. Flanged pivot bushings 63 are used to locate the support arms and provide radial and thrust bearing surfaces. The bushings 63 are made of phosphor-bronze or any other suitable bearing material.

Figure 7:
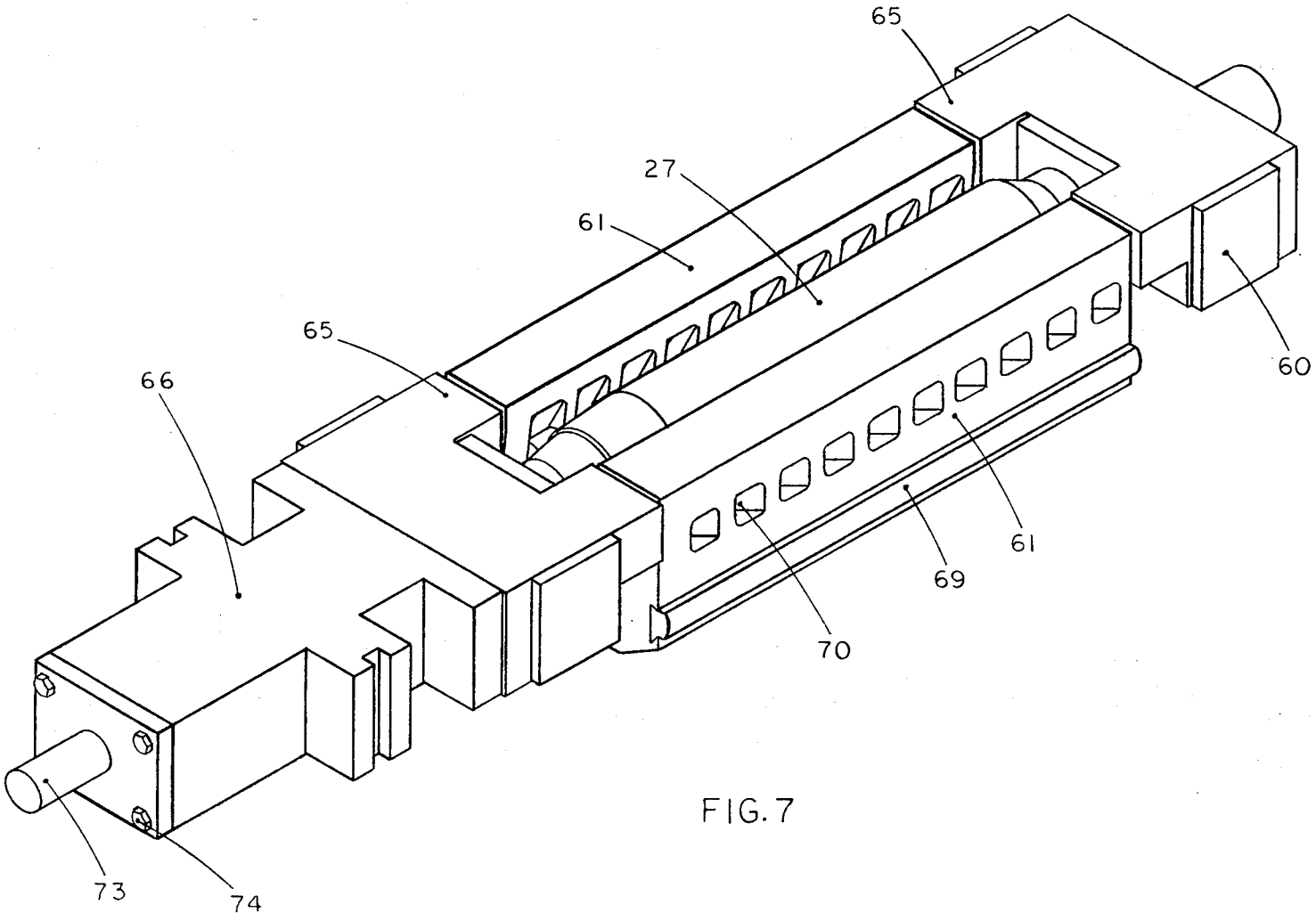
FIG. 7 is an isometric view of a complete six-high intermediate roll assembly, including intermediate roll chocks and side support bearing support arms.

The result of this construction is illustrated in the isometric view of the upper assembly shown in FIG. 7. The complete upper intermediate roll assembly consists of drive side chock 60, operator side chock 66, intermediate roll 27, left and right support arms 61, and left and right side support roll assemblies, each of the assemblies consisting of side support rolls 28, rollers 21 and 22, bearings 47 and **47*a* and backing shafts 46 and 46*a***. There are also other small parts such as screws and retainers which constitute parts of said support arms, but which, for the sake of clarity, are omitted from the drawings.

Figure 3:
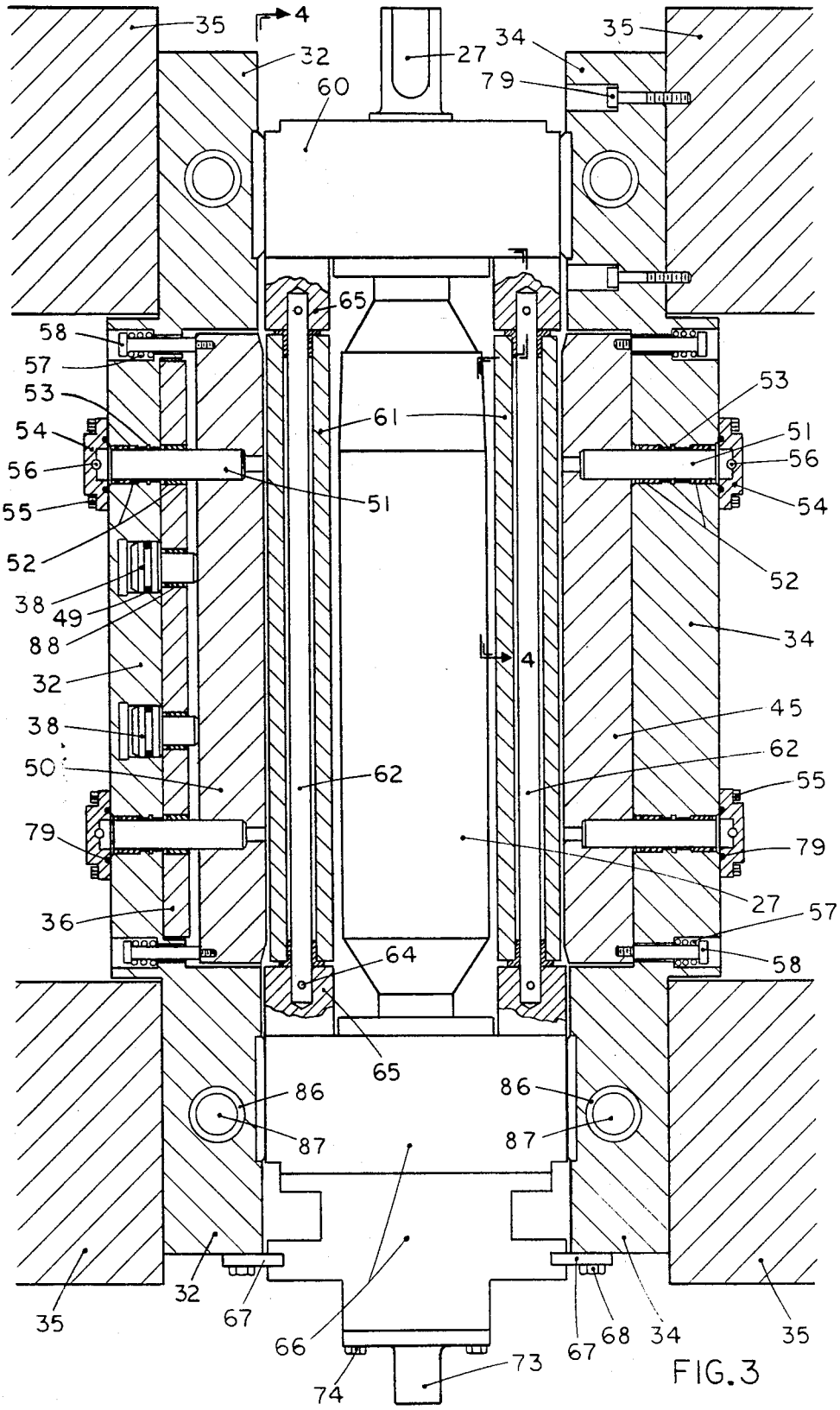
FIG. 3 is a fragmentary cross-sectional view of the mill of FIG. 2, taken along section line 3—3 of FIG. 2.
Figure 4:
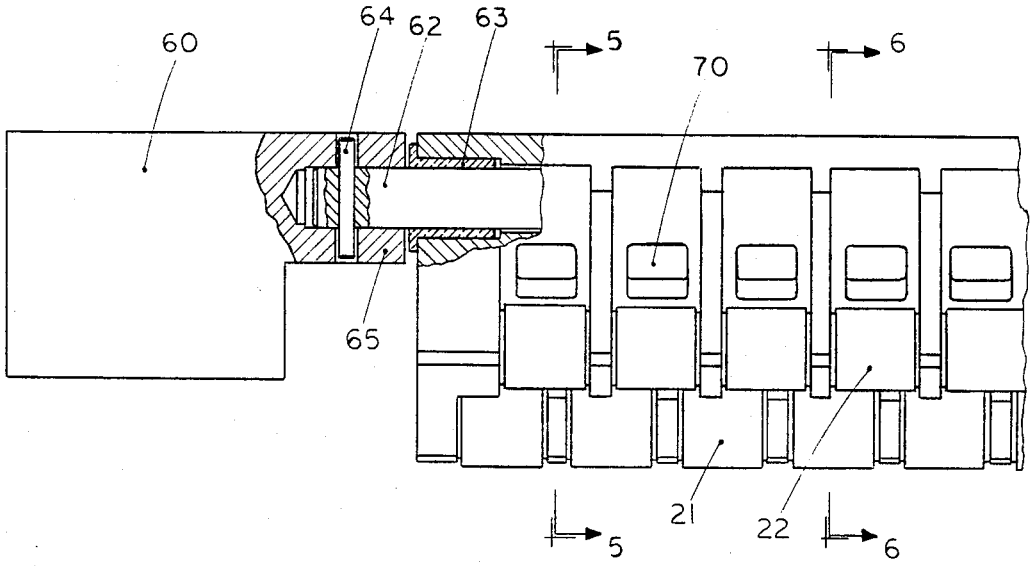
FIG. 4 is a fragmentary cross-sectional view taken along section line 4—4 of FIG. 2 and showing the arrangement and mounting of staggered side support bearings on the support arm.

It can be seen from FIGS. 2 and 3 that the support arms 61 and side support roll assemblies fit within the width of the intermediate roll chocks 60 and 66, hence the complete intermediate roll assembly can be inserted into and removed from the mill by sliding in and out in a direction along the axis of the rolls.

Operator side chock 66 has an adapter 73 attached to it by means of screws 74. This adapter enables a porter bar to be used to lift the assembly. The whole assembly can be quickly removed from and re-inserted into the mill by means of the porter bar according to the prior art. The procedure for removal is exactly the same as the prior art procedure for changing four-high mill work roll assemblies, namely: (i) support drive spindles, (ii) disconnect any hose connections supplying lubricant/coolant/hydraulic oil, (iii) disengage keeper plates, (iv) remove upper assembly using porter bar, and (v) remove lower assembly using porter bar. (For insertion, the procedure is reversed.) This procedure normally takes about 2O minutes.

Figure 8:
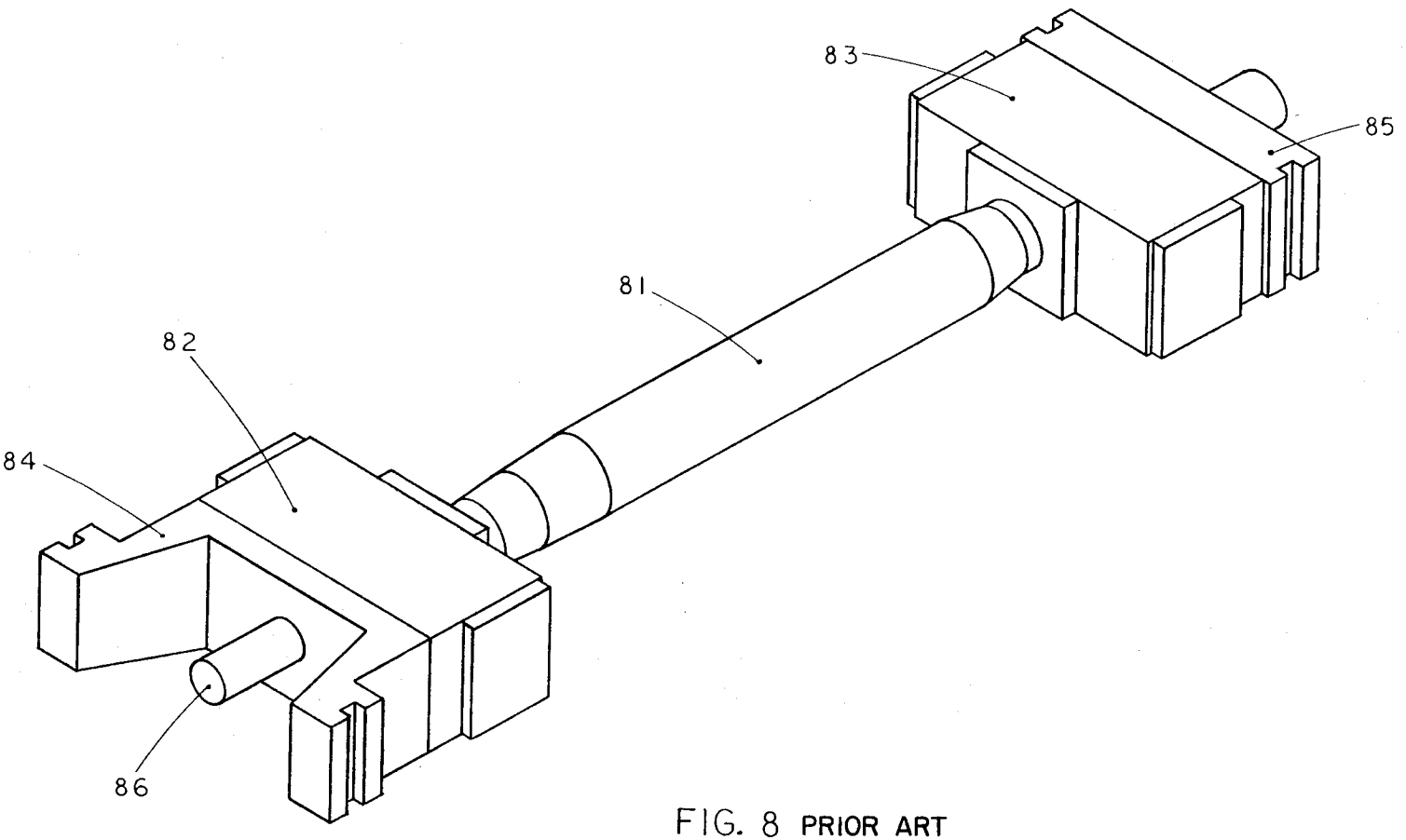
FIG. 8 PRIOR ART
FIG. 8 is an isometric view of a complete four-high work roll assembly, corresponding to the six-high intermediate roll assembly of FIG. 7.

FIG. 8 shows a typical prior art four-high mill work roll assembly consisting of work roll 81, drive side chock 83, operator side chock 82, and keeper plate adapters 85 (drive side) and 84 (operator side). The operator side end of work roll 81 is provided with an extension 86 which the porter bar fits on to when the assembly is to be removed from or inserted into the mill.

It can be readily seen that the assembly of the present invention (FIG. 7) can be handled in and out of the mill in the same manner as the four-high work roll assembly of FIG. 8.

Figure 13:
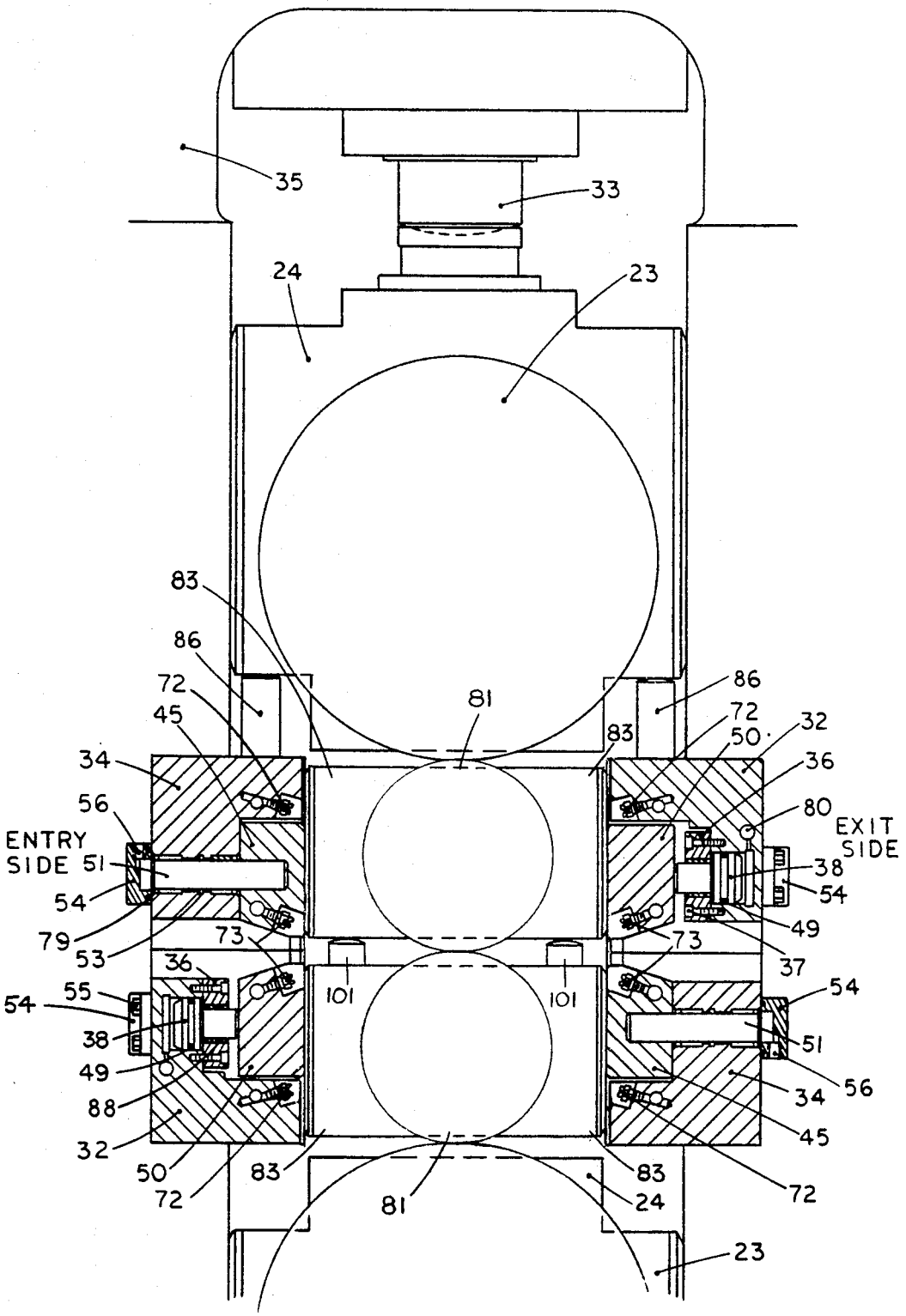
FIG. 13 is a fragmentary cross-sectional elevational view, similar to FIG. 2, and illustrating the mill in its four high mode.

A further advantage of this new approach is that, if the work roll chocks of FIG. 8 have the same basic dimensions and spacing as the intermediate roll chocks of FIGS. 2–7, and work roll 81 has suitable dimensions, then it is possible to remove the work rolls and intermediate roll assemblies completely from the mill of FIGS. 2 and 3 and insert two of the assemblies of FIG. 8 into the mill. This would convert the side-supported six-high mill as shown in FIG. 13 to a four-hlgh mill. Furthermore, if the porter bar adapter 73 of the intermediate roll assembly of FIG. 7 has the same diameter and length as the work roll extension 86 of FIG. 8, then the same porter bar can be used to handle both sets of assemblies and very quick conversion of the mill from four-high to six-high, and vice versa, can be achieved. This feature is of great value, as there are some applications (such as temper rolling) for which a large work roll is advantageous and, for many mill users, a mill that is quickly convertible from, for example, a temper mill (large work rolls) to a reduction mill (small work rolls) would be of great value. Such a mill is not generally available in the prior art.

In another embodiment of the present invention, support arms 61 are mounted in horizontal slides in intermediate roll chocks 60 and 66 rather than being pivotally mounted. Clearly, the precise form of mounting upon the intermediate roll chocks is not important provided that the support arms are supported in a vertical plane, located in a direction parallel to the roll axes, and are free to move in a horizontal direction normal to the roll axes.

Other improvements in the design of the support arms 61 are as follows: Support arms 61 are provided with dovetail slots in which spacers 69 slideably mount. These spacers can be quickly changed and are provided in several sets with different thicknesses and are used to maintain the work roll axes at, or close to, the vertical center line of the mill and to take out excessive lateral clearance which would otherwise arise after wear of work rolls 30. In another embodiment, the dovetail slot in each support arm 61 is machined at an angle relative to the roll axes so that the slot depth increases linearly along the length of the support arm. Spacer 69, which fits into said slot, is machined with a taper which matches the angle of the slot so that, upon assembly, the curved thrust surface on the spacer remains parallel to the roll axes. Means are provided to adjust each of said spacers in a direction parallel to the roll axes. Due to the effect of the taper, the spacers move in a lateral direction (i.e., normal to the vertical plane containing the work roll axes) as this adjustment is made, thus effectively changing the spacer thickness. In this way, lateral clearance can be adjusted without the necessity of changing spacers. Spacers 69 are provided with a curved thrust surface to ensure that they are never corner loaded. This is important because the support arms 61 tilt (pivoting on pivot shaft 62) to a different position for each thickness of spacer. The support arms 61 also have holes 70 (FIGS. 5 and 7) which are provided to enable cooling and lubricating oil to be applied to the rolls by means of spray nozzles 72, which are mounted in fixed side support beams 32 and 34 (see FIG. 2).

Each support arm 61 has two sets of recesses machined in it. Recesses 71 provide spaces for mounting of rollers 22, and recesses 72 provide space for mounting of rollers 21. Since recesses 71 and 72 are offset from each other, this results in an axial offset or stagger of rollers 21 relative to rollers 22 and this has the effect of evening out the wear on side support rolls 28 to minimize any tendency of wear marks developing on the side support rolls, which otherwise may be transferred to work rolls 30, and ultimately to the rolled strip, to the detriment of its quality. The side support rolls 28 are usually made from a material softer than that of the work rolls 30 so that any wear marks on the side support rolls 28 will not be readily transferred to the work rolls 30. Rollers 21 and 22 may be of the same size, as shown, or rollers 21 may be made larger than rollers 22 since, because of the geometry of the cluster, rollers 21 are normally subject to higher loading than rollers 22 during rolling.

Figure 5:
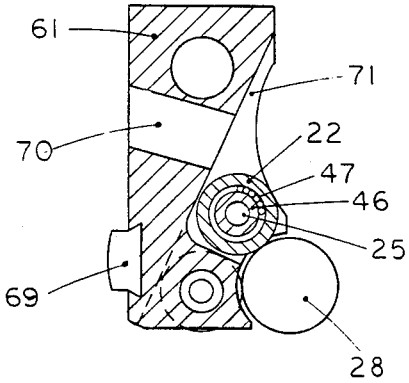
FIG. 5 is a transverse cross-sectional view of a support arm and cluster assembly, taken along section line 5—5 of FIG. 4.
Figure 6:
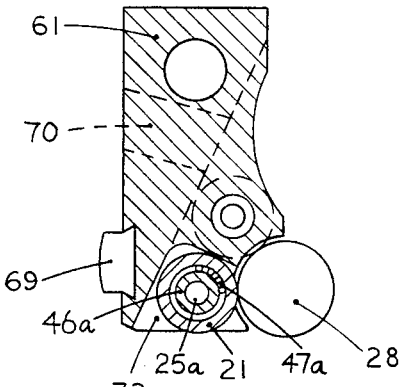
FIG. 6 is a transverse cross-sectional view of a support arm and cluster assembly, taken along section line 6—6 of FIG. 4.

Side support bearing shafts 46 and **46*a* are each provided with a central oil hole 25 and 25*a* through which lubricating oil is supplied to the bearings (see FIGS. 5 and 6**).

Side support rolls 28 are normally spring loaded against rollers 21 and 22 at all times.

Figure 11:
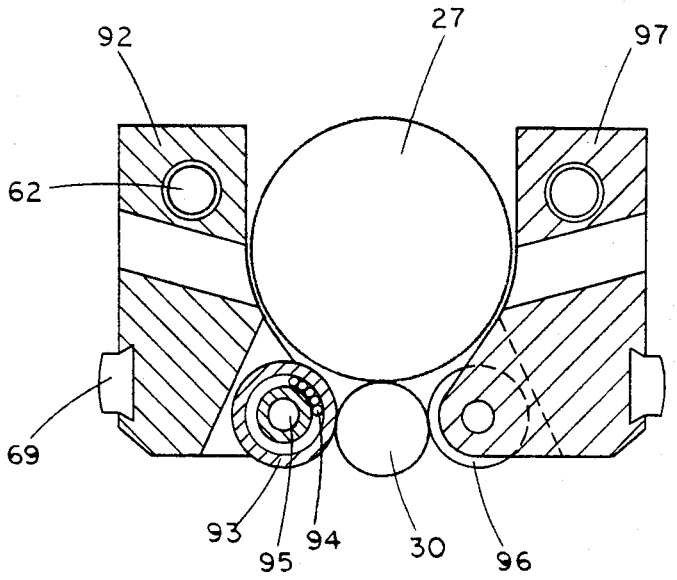
FIG. 11 is a fragmentary cross-sectional elevation of a mill according to a second embodiment of the present invention, showing the upper intermediate roll, work roll and support arm assemblies.

It should be noted that the method of mounting the support arms on the intermediate roll chocks is not restricted to mills according to U.S. Pat. No. 4,270,377. Another type of six-high mill with side supported work rolls is shown in U.S. Pat. No. 2,907,235. This type of mill uses a lateral support roll assembly consisting of a single roll or set of rollers on each side of each work roll. FIG. 11 shows how the arrangement for mounting the support arms shown in FIGS. 2–4 can be applied to a mill of this type. In FIG. 11, support arm 92 is provided with recesses for mounting a set of rollers 93, which is mounted on roller bearing sets 94 and stationary shaft 95. Rollers 93 bear directly against work roll 30. Support arm 92 is pivotally mounted to the intermediate roll chocks 60 and 66 in identical fashion to the mounting of support arms 61 on these chocks, as shown in FIG. 3. Alternatively, rollers 93 can be replaced with a single full width roll 96 bearing mounted to support arm 97, as shown on the right side of FIG. 11. Clearly, the method of mounting the work roll side support devices on the intermediate roll chocks can be used regardless of the particular type of lateral support roll assembly employed.

The design of the side support assemblies of the present invention can best be understood by reference to the preferred embodiment of FIGS. 2 and 3.

Since the clearances produced by the wear of work rolls and side support rolls are taken up by selecting spacers 69 of the appropriate thickness, it is not necessary to provide any adjustment of the position of the side support beams themselves for this purpose. Therefore, these beams could, in principle, be fixed solid steel spacer beams which transfer the lateral rolling forces from the cluster arms 61 via spacers 69 to the mill housings 35.

However, in the event of a mill wreck which is bound to occur from time to time, it is possible for the rolled strip to jam between the work roll and side support rolls and, with fixed side support beams, this could result in excessive forces on the support arm assemblies. To protect against this possibility, hydraulically-supported beams are provided, which will release before the lateral forces reach an excessive level, but will maintain a fixed position under normal operation. The beams also incorporate sprays for cooling and lubrication of the strip and the rolls, and also contain air or hydraulic cylinders which are used during rolling to hold the exit side roll clusters (which would otherwise be unloaded) lightly against the work roll. This ensures that all rolls turn at all times and eliminates the possibility of the unloaded rolls skidding on and marking each other. In the preferred embodiment shown in FIG. 3, the beam assemblies extend into the window area and are used for locating the intermediate roll chocks and for mounting the back-up roll balance cylinders.

As shown in FIGS. 2 and 3, fixed side support beams 34 are mounted at upper left and lower right, and fixed side support beams 32 are mounted at lower left and upper right. All four of these beams span between operator side and drive side mill housings 35 to which they are attached by screws 79. The beams are also each bored out in two places to provide for mounting of upper back-up roll balance cylinders 86, within which rams 87 slide. At the operator side, slotted keeper plates 67 are mounted on the beams using clamp screws 68. By loosening said clamp screws, said keeper plates can be slid out to engage the slots in chocks 66. Tightening of said clamp screws thus locks the intermediate roll assembly in the mill. If the keeper plates are retracted, the intermediate roll assembly can be removed from the mill in an axial direction.

Each beam 32 is recessed to provide space for movable beam 50, known as an overload beam, which is slideably mounted in beam 32 by means of guide pins 51 and bushings 52. The guide pins 51 are press fitted in the overload beam 50 and slide freely in the bushings 52. Each beam 32 is bored in a plurality of places (two places in the embodiment of FIG. 3) to form cylinders which accommodate hydraulic pistons 38, which are retained in the beam by means of retainer plate 36, attached to the beam by screws 37. The hydraulic pistons are guided in the retainer plate by bushings 88. The hydraulic pistons are sealed by seals 49 and pressurized hydraulic oil is introduced through holes 80. This oil extends the pistons fully, thus setting them against the stop formed by the retainer plate 36. Overload beam 50 bears against the pistons 38 and horizontally acting rolling forces are transmitted through the cluster assembly, spacer 69 and overload beam 50 to the pistons. A hydraulic pressure regulator valve (not shown) is provided so that the hydraulic force applied to the pistons 38 is sufficient to support all normal rolling forces. A hydraulic relief valve (not shown) is also provided so that, if the rolling force exceeds a predetermined level (for example, 20% higher than the normal maximum), the relief valve will blow and the pistons 38 will move back to relieve the forces. A limit switch or pressure switch (not shown) will normally be used to sense when this condition occurs in order to warn the mill operator or to stop the mill automatically by electrical interlock. Because of their function, the assemblies consisting of the cylinders and hydraulic pistons 38 and associated parts are known as the overload cylinders.

Return springs 57, in conjunction with shoulder screws 58, hold overload beam 50 firmly against pistons 38 (see FIG. 3). Covers 54 are attached to beam 32 by screws 55 and sealed by O-rings 79. The covers 54, together with guide pins 51 sealed by seals 53, form pneumatic cylinders of which the guide pins 51 form the pistons. During rolling, air is introduced through ports 56. When the horizontal rolling force acts in a direction to push overload beam 50 against pistons 38, the air cylinders have no effect since they are far too weak to overcome rolling forces. When the force acts in the opposite direction, however, (which occurs when the direction of rolling reverses) overload beam 50 is pushed by the air cylinders against the adjacent cluster arm assembly and preloads it against the work roll. For this reason, the pneumatic cylinders are called preload cylinders.

Each of the fixed side support beams 34 is similar in construction to side support beams 32, except that no hydraulic overload cylinders are provided in the former. Each beam 34 is recessed to provide space for movable beam 45, known as a preload beam, which is slideably mounted in beam 34 by means of guide pins 51 and bushings 52. The guide pins 51 are press fitted in the preload beam 45 and slide freely in bushings 52. Covers 54 are attached to beam 34 by screws 55 and sealed by O-rings 79. The covers, together with said guide pins sealed by seals 53, form pneumatic cylinders, of which the guide pins 51 form the pistons. When the horizontal rolling force acts in a direction to push preload beam 45 against beam 34, the air cylinders have no effect since they are far too weak to overcome rolling forces. When said force acts in the opposite direction, however, (which occurs when the direction of rolling reverses) preload beam 45 is pushed by the air cylinders against the adjacent cluster arm assembly and preloads it against the work roll. For this reason, the pneumatic cylinders are called preload cylinders. Return springs 57, in conjunction with shoulder screws 58, hold preload beam 50 firmly against beam 34, but allow the preload beam to move away from beam 34 when the preload cylinders are operated. It would also be possible to operate the preload cylinders with oil instead of air.

When rolling in a left-to-right direction (FIG. 2), the horizontal rolling force components force the work rolls 30 to the left. The upper left preload beam 45 is thus pushed hard against, and is supported by, fixed beam 34. The lower left overload beam 50 is pushed against, and is supported by, lower hydraulic pistons 80. Thus, upper and lower left preload cylinders have no effect. The lower right preload beam 45 and upper right overload beam 50 are clearly not subjected to the horizontal rolling force components in this case, hence the right preload cylinders operate and guide rods 51 push the upper right overload beam 50 and the lower right preload beam 45 against upper and lower right cluster arm assemblies, respectively, and preload the assemblies against upper and lower work rolls 30, respectively.

When rolling in a right-to-left direction (FIG. 2), the horizontal rolling force components force the work rolls to the right. In this case, the lower right preload beam 45 is thus pushed hard against, and is supported by, fixed beam 34. The upper right overload beam 50 is pushed against, and is supported by, upper hydraulic pistons 38. The upper and lower right preload cylinders have no effect. The upper left preload beam 45 and lower left overload beam 50 are clearly not subjected to said horizontal rolling force components in this case, hence the left preload cylinders operate and guide rods 51 push the upper left preload beam 45 and the lower left overload beam 50 against upper and lower left cluster arm assemblies, respectively, and preload the assemblies against upper and lower work rolls 30, respectively.

The embodiment shown in FIGS. 2 and 3 is designed primarily for a reversing mill, as the above description implies. In such a case, it is desirable to have one overload system on the left, and one system at the right, so that excessive horizontal rolling forces, which generally act towards the entry side of the mill (since the major components of such forces are torque reaction forces, as is well known in the art), can be prevented. It is also always desirable to have one overload system for the upper half of the mill and one for the lower half since, in a mill wreck, the rolled strip may wrap itself around the upper work roll or the lower or jam into any one of the cluster arm assemblies. The embodiment of FIG. 2 satisfies both of these requirements by having overload cylinders at upper right and lower left. Even in a reversing mill, wreck protection will be provided if overload systems for the upper and lower halves of the mill are provided, both located to the same side of the work rolls. Clearly, it would also be possible to satisfy these requirements by having overload cylinders at upper left and lower right (same cost) or at upper and lower left, and upper and lower right (higher cost). Furthermore, for a one-way mill, the above requirements would be met by having overload cylinders mounted at the entry side only. It is also possible, in applications where there is no danger of overload, to provide none of the beam assemblies with overload cylinders. All of these possible arrangements clearly fall within the scope of the present invention.

Operation of the side support beam system is as follows (with reference to FIG. 2). The overload cylinders are provided with pressurized hydraulic oil at all times, even when the mill is stopped. The preload cylinders are only provided with pressurized air when the mill is turning.

When the mill is stationary, the left hand vertical faces of upper right overload beam 50 and lower right preload beam 45 are exactly in line, and the right hand vertical faces of upper left preload beam 45 and lower left overload beam 50 are exactly in line. Because the preload cylinders are not pressurized, upper and lower roll cluster assemblies are loose and it is possible, provided that the mill screwdown is open, to slide upper and lower work rolls in or out of the mill in order to change rolls. Furthermore, it is possible to slide spacers 69 in or out of the mill in order to change spacers.

When any such roll change or spacer change is completed, the preload cylinders are pressurized (either by manual operator selection or by electrical interlock from an existing control such as the operator's "mill direction" selector). It is usual to provide a higher air pressure in the preload cylinders on one side than on the other. For example, the left side preload cylinders (FIG. 2) may operate at 80 psi and the right side preload cylinders may operate at 60 psi. This is in order to offset both work rolls in the same direction (to the right in the above example) as this ensures that, when the vertical roll separating force is applied by operating the screwdown, the horizontal component of this force arising on the work rolls 30 (due to the small off-set of their axes from the vertical center line of the machine) will be minimized. When rolling commences, a horizontal torque reaction force develops on each work roll 30, pushing it towards the entry side of the mill. In the above example, if rolling commences in a right-to-left direction, the torque reaction forces act to force the work rolls 30 to the right (i.e., in the same direction as the initial preload force) and the work rolls 30 remain offset slightly to the right. If rolling commences in a left-to-right direction, the torque reaction forces act to force the work rolls 30 to the left, and the work rolls 30 will both move a very small distance to the left so that rolling continues with the work roll axes offset slightly to the left of the vertical center line of the machine. Regardless of the rolling direction, the preload cylinders will operate to hold those roll cluster assemblies not subjected to rolling forces tight against the respective work rolls 30.

Figure 10:
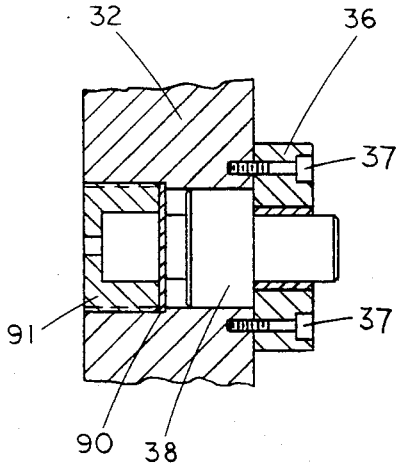
FIG. 10 is a fragmentary cross-sectional view of a stationary side support beam, showing a shear diaphragm-type overload protection device.
Figure 9:
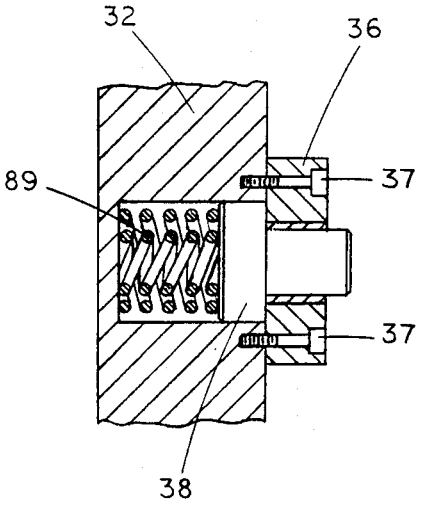
FIG. 9 is a fragmentary cross-sectional view of a stationary side support beam, showing construction of a spring loaded overload protection device.

In another embodiment of the invention shown in FIG. 9, each piston 38 is preloaded by springs 89 rather than hydraulic oil, the springs becoming preloaded by the action of screws 37 in tightening retainer plate 36 against beam 32. The action of the springs is virtually identical to that of the hydraulic system, in that they allow piston 38 to move back to relieve the force if the rolling force exceeds the preload force. In a third embodiment, shown in FIG. 10, each piston 38 is preloaded by means of a retainer 91 and a diaphragm 90. In this case, if the rolling force exceeds the strength of the diaphragm, the diaphragm will shear and allow the piston to move back to relieve the force. Alternatively, shear pins, spring detents or other such commonly used force limiting devices could also be used without departing from the spirit of the invention.

It will be understood by one skilled in the art that the teachings of this disclosure could be applied to either the upper or lower half only of a six-high mill, the other half of the mill being conventional.

For cases where existing four-high mills are converted to operation as side-supported six-high mills, it has been shown above that our invention enables very quick conversion from four-high to side-supported six-high operation and vice versa.

In another embodiment of our invention which is generally intended for new mills (and for the conversion of existing conventional six-high mills), where occasional operation with large work rolls is desired, the mill is convertible between conventional six-high mode of operation and the side-supported six-high mode of operation. This concept has the advantages that, firstly, laterally adjustable intermediate rolls will be useable in conjunction with large work rolls, and secondly, there will be no changes in the sense of rotation of the drive. In such cases, therefore, conventional six-high operation would be incorporated in preference to, and instead of four-high operation. Note that this option is not normally feasible as a conversion of existing four-high mills, because the height of the housing window is usually insufficient to allow a six-high roll stack having large work rolls (i.e. a conventional six-high roll stack).

Figure 12:
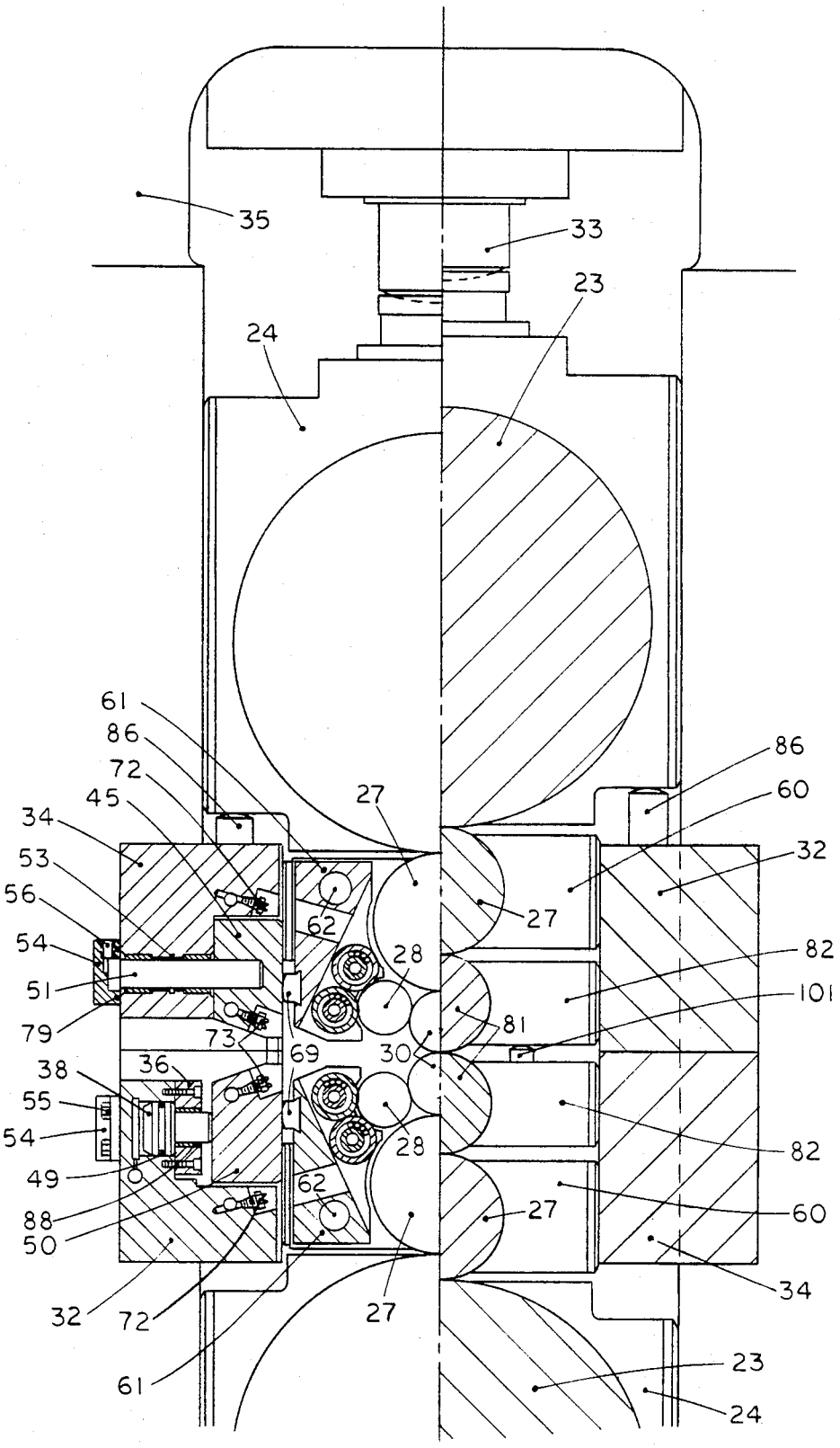
FIG. 12 is a fragmentary, composite, cross sectional view, the right hand side of the FIG. illustrating the mill in its conventional six-high mode and the left hand side of the Fig. illustrating the mill in its side-supported six-high mode.

This embodiment is shown in FIG. 12, a split transverse cross sectional elevation, with the side-supported six-high configuration shown on the left, and the conventional six-high configuration shown on the right. The side-supported six-high configuration is seen to be virtually identical to the configuration of FIG. 2, the only difference being the height of stationary beams 32 and 34 which is increased. The six-high configuration is seen to be conventional, with chock mounted work rolls and intermediate rolls. The work roll arrangement is substantially as shown in FIG. 8 (i.e. it is structurally similar to the four-high work roll arrangement described above). Hydraulic rams 101 (FIG. 12) are mounted in lower work roll chocks 82 and bear against upper work roll chocks 83 in order to support the upper work roll and intermediate roll and thus ensure a gap between the work rolls when there is no strip in the mill (it being noted that this is a prior art technique used on four-high mills to support the upper work rolls). Work roll chocks 82 have the same width as intermediate roll chocks 60 (drive side) and work roll chocks 83 have the same width as intermediate roll chocks 66 (operator side) in order to fit the horizontal gap between side support beams 32 and 34.

In order to change from side-supported six-high operation to conventional six-high operation, the following steps are taken:

1. Remove the small work rolls 30 (by hand);
2. Remove the side-supported six-high intermediate roll assemblies (FIG. 7) using a porter bar (as previously described);
3. Remove the support arm assemblies (FIGS. 4, 5, 6, 7) from each intermediate roll assembly by withdrawing roll pins 64 and sliding out pivot shafts 62 and support arms 61. Insert the intermediate roll assemblies back into the mill (using a porter bar);
4. Insert the six-high large work roll assemblies (FIG. 8) into the mill using a porter bar. Actuate the hydraulic rams 101 to support the weight of the upper work roll and intermediate roll assemblies.

Note that, insertion and removal of roll assemblies as briefly described above is according to the prior art and is more fully described elsewhere in this specification.

Modifications may be made in the invention without departing from the spirit of it.

What is claimed is:

1. In a side-supported six-high rolling mill of the type having a pair of housings, a pair of small vertically in-line free-floating work rolls and vertically in-line chock-mounted back-up rolls with chock mounted intermediate rolls located in-line and between said work rolls and said back-up rolls, lateral support roll assemblies mounted on each side of each work roll and support means for each of said lateral support roll assemblies, said lateral support roll assemblies being chosen from the class consisting of a single side support roll, and a single side support roll together with a pair of backing roll assemblies, the improvement wherein each of said support means for each of said lateral support roll assemblies comprises a support arm mounted upon said chocks of the adjacent one of said intermediate rolls, said mounting allowing horizontal adjustment of said lateral support roll assembly, a spacer to adjust the horizontal position of said lateral support roll assembly; and a stationary side support beam assembly, which provides rigid support for said spacer and said support arm.

2. An improved rolling mill according to claim 1 wherein said lateral support roll assemblies and support arms are dimensioned to fit within the width of the intermediate roll chocks, enabling intermediate roll assemblies, which each comprise an intermediate roll, a pair of intermediate roll chocks, a left and a right lateral support roll assembly and support arms therefor to be inserted into and removed from the mill as a unit by moving them in a direction parallel with the roll axis.

3. A mill according to claims 1 or 2 wherein a pair of chock-mounted work rolls are provided whose chocks have the same width as those of said intermediate roll chocks, enabling said mill to be quickly converted from six-high operation to four-high operation by sliding out the six-high work rolls and intermediate roll assemblies and sliding in the chock mounted work rolls.

4. An improved rolling mill according to claim 1 wherein said stationary side support beam assembly comprises a movable beam guidably mounted on a rigid stationary spacer beam mounted between said two housings of said mill, overload prevention means mounted on said spacer beam for setting the horizontal working position of said movable beam, and for limiting the horizontal rolling force component that said overload prevention means will support when said force component acts towards said overload prevention means, spring return means to pull said movable beam towards said overload prevention means, and cylinder means to push the adjacent lateral support roll assembly towards the work roll, in order to take out the clearance between said lateral support roll assembly and work roll when said force component acts away from said overload prevention means.

5. An improved rolling mill according to claim 1 wherein one of said stationary side support beam assemblies to one side of one of said work rolls and one of said stationary side support beam assemblies to the other side of the other of said work rolls each comprise a movable beam guideably mounted on a rigid stationary spacer beam mounted between said two housings of said mill, overload prevention means mounted on said spacer beam for setting the horizontal working position of said movable beam, and for limiting the horizontal rolling force component that said overload prevention means will support, when said force components act towards said overload prevention means, spring return means to pull said movable beam towards said overload prevention means, and cylinder means to push the adjacent lateral support roll assembly towards the work roll, in order to take out the clearance between said lateral support roll assembly and work roll when said force component acts away from said overload prevention means, the remaining ones of said stationary side support beam assemblies each comprising a movable beam guidably mounted on a rigid stationary spacer beam mounted between said two housings of said mill, spring return means to pull said last mentioned movable beam towards said last mentioned spacer beam and cylinder means to push the adjacent lateral support roll assembly towards the work roll, in order to take out the clearance between said lateral support roll assembly and the work roll when the horizontal rolling force component acts away from said last mentioned spacer beam.

6. An improved rolling mill according to claim 1 wherein said stationary side support beam assemblies to one side of said work rolls each comprise a movable beam guidably mounted on a rigid stationary spacer beam mounted between said two housings of said mill, overload prevention means mounted on said spacer beam for setting the horizontal working position of said movable beam, and for limiting the horizontal rolling force component that said overload prevention means will support when said force component acts towards said overload prevention means, and spring return means to pull said movable beam towards said overload prevention means, said stationary side support beam assemblies on the other side of said work rolls each comprising a movable beam guidably mounted on a rigid stationary spacer beam mounted between said two housings of said mill, spring return means to pull said last mentioned movable beam towards said last mentioned spacer beam and cylinder means to push the adjacent lateral support roll assembly towards the work roll, in order to take out the clearance between said lateral support roll assembly and the work roll when the horizontal rolling force component acts away from said last mentioned spacer beam.

7. An improved rolling mill according to claim 1 wherein said stationary side support beam assembly comprises a movable beam guidably mounted on a rigid stationary spacer beam mounted between said two housings of said mill, spring return means to pull said movable beam towards said spacer beam and cylinder means to push the adjacent lateral support roll assembly towards the work roll, in order to take out the clearance between said lateral support roll assembly and the work roll when the horizontal rolling force component acts away from said spacer beam.

8. The mill according to claim 4 wherein said overload prevention means comprises hydraulic cylinder means.

9. The mill according to claim 5 wherein said overload prevention means comprises hydraulic cylinder means.

10. The mill according to claim 6 wherein said overload prevention means comprises hydraulic cylinder means.

11. A mill according to claims 1 or 2 including a pair of chock-mounted large work rolls, said work roll chocks having the same width as said intermediate roll chocks, enabling said mill to be quickly converted from side-supported six-high operation to conventional six-high operation by sliding out said small free-floating work rolls and said intermediate roll assemblies, removing said support arm assemblies from said intermediate roll assemblies, re-inserting said intermediate roll assemblies in said mill, and sliding in said chock-mounted work rolls.

12. A mill according to claim 1 wherein each of said lateral support roll assemblies comprises a single side support roll fully supported throughout its length in both vertical and horizontal planes by two backing roll assemblies, each of said backing roll assemblies comprising a number of rollers rotatably mounted upon a stationary shaft and support means to mount said shafts and support said shafts at intervals throughout their length, one of said two backing roll assemblies being axially offset with respect to the other to even out the wear produced on said side support roll by said backing roll assemblies.

13. A mill according to claim 1 wherein each of said lateral support roll assemblies comprises a single side support roll fully supported throughout its length in both vertical and horizontal planes by two backing roll assemblies, each of said backing roll assemblies comprising a number of rollers rotatably mounted upon a stationary shaft and support means to mount said shafts and support said shafts at intervals throughout their length, the diameter of the rollers of the more heavily loaded of said backing roll assemblies being greater than the diameter of the rollers of the less heavily loaded of said backing roll assemblies, so that the roller diameters of the respective backing roll assemblies are substantially proportional to the load on each of said back roll assemblies.

* * * * *